US007785039B1

(12) United States Patent
McCown, Sr.

(10) Patent No.: US 7,785,039 B1
(45) Date of Patent: Aug. 31, 2010

(54) PIER DRIVING AND FOUNDATION LIFTING ASSEMBLY

(76) Inventor: William B. McCown, Sr., P.O. Box 780852, Wichita, KS (US) 67278-0852

( * ) Notice: Subject to any disclaimer, the term of this patent is extended or adjusted under 35 U.S.C. 154(b) by 98 days.

(21) Appl. No.: 12/258,797

(22) Filed: Oct. 27, 2008

(51) Int. Cl.
*E02D 7/02* (2006.01)
*E02D 27/48* (2006.01)

(52) U.S. Cl. ..... 405/230

(58) Field of Classification Search ..... 405/230
See application file for complete search history.

(56) References Cited

U.S. PATENT DOCUMENTS 4,673,315 A * 6/1987 Shaw et al. ..... 405/230
4,765,777 A * 8/1988 Gregory ..... 405/230
4,911,580 A * 3/1990 Gregory et al. ..... 405/230
4,925,345 A * 5/1990 McCown et al. ..... 405/232
5,205,673 A * 4/1993 Bolin et al. ..... 405/230
5,269,630 A * 12/1993 Bolin et al. ..... 405/230
5,482,407 A * 1/1996 Raaf ..... 405/230
5,492,437 A * 2/1996 Ortiz ..... 405/230
6,142,710 A * 11/2000 Holland et al. ..... 405/230
6,514,012 B2 * 2/2003 Gregory et al. ..... 405/230
6,676,335 B1 * 1/2004 Hickman ..... 405/230
2005/0013671 A1 * 1/2005 Vache ..... 405/230
2007/0231080 A1 * 10/2007 Gregory et al. ..... 405/230

* cited by examiner

*Primary Examiner*—Sunil Singh
(74) *Attorney, Agent, or Firm*—Kenneth H. Jack; Davis & Jack, L.L.C.

(57) ABSTRACT

An assembly for driving pier sections and for foundation lifting, the assembly incorporating a "T" bar having a stem, a left arm, and a right arm, the stem having lower end and an upper end, and the stem forming a vertically extending and rearwardly opening channel which is fitted for receipt of the pier sections; the assembly further incorporating a collet clamp for alternatively clamping and releasing pier sections, the collet clamp being welded to the lower end of the "T" bar; the assembly further incorporating a sleeve having a bore which is fitted for sliding receipt of the pier sections; the assembly further incorporating left and right hydraulic cylinders spanning between and vertically interconnecting the "T" bar's arms and the sleeve; and the assembly further incorporating a foundation hooking member fixedly attached to and extending forwardly from the sleeve.

9 Claims, 8 Drawing Sheets

PIER DRIVING AND FOUNDATION LIFTING ASSEMBLY

FIELD OF THE INVENTION

This invention relates to apparatus, machines, and assemblies for raising sunken building foundations. More particularly, this invention relates to such assemblies, apparatus, and machines which drive piers at a building's foundation, which raise the building's foundation upon such piers.

BACKGROUND OF THE INVENTION

Commonly known assemblies for downward driving of pier sections, and for lifting of building foundations upon the driven pier sections incorporate and utilize a conically bored drawing sleeve and wedge shaped collet shoes assembly (i.e., a collet clamp) for substantially annularly clamping a foundation support pier. Such collet clamp allows hydraulic cylinder actuated machinery to drive the pier downwardly into the earth at a building's foundation, and thereafter, upon placement of the pier, to upwardly draw and lift the building's foundation along such pier for assisted support by the pier. Commonly known drawbacks or deficiencies of such foundation lifting collet clamp assemblies arise as the result of the mechanically required orientation of the conical bore of the collet clamp's drawing sleeve, and as the result of the mechanically required annular or completely circumferential configuration of the clamp's drawing sleeve component.

In order for the drawing sleeve component of a pier clamping assembly to effectively radially inwardly drive the assembly's wedge shaped collet shoes against a pier section which extends vertically through the sleeve, such sleeve's conical bore must flare or widen in the downward direction. The direction of the downward flare is necessarily consistent with the downwardly directed forces which are applied by the collet clamp to the pier upon pier driving or upon subsequent foundation lifting. Such mechanically necessary downward flare of the drawing sleeve's conical bore results in a thickening of the annular wall of the drawing sleeve at its upper end, and results in a corresponding thinning of such wall at the sleeve's lower end. In order for such drawing sleeves to effectively drive their wedge shaped collet shoes radially inwardly against the outer wall of a pier to be annularly clamped, the horizontal cross-sectional shape of the drawing sleeve must remain precisely circular, especially at such sleeve's lower end. In the event that the lower end of the drawing sleeve deforms into an oval horizontal cross-sectional shape, the size or "footprint" of the underlying contact points between the teeth of the wedge shaped collet shoes and the pier becomes undesirably diminished and localized along narrow vertically extending lines of contact rather than along the circumferentially extending ridges of the teeth. Such diminishment of contact points reduces friction. Accordingly, upon occurrence of such drawing sleeve wall deformation, slippage of the pier through the clamping assembly may undesirably occur. Where hydraulic cylinder attaching clevises or eyed flanges are directly welded to the outer wall of the drawing sleeve of such collet clamp assembly (a configuration commonly utilized in the foundation lifting arts) downwardly directed load forces applied to such flanges or clevises tend to lever or twist such flanges or clevises against the relatively thin walled lower periphery of the drawing sleeve. Resultant extreme localized twisting forces directed against the relatively thin lower end of the drawing sleeve tends to undesirably bend the drawing sleeve into such oval shape, causing clamp slippage.

A second drawback or deficiency (arising as the result of the completely annular or circumferential configuration of the drawing sleeve component of the collet clamp) becomes especially disadvantageous in circumstances where foundation lifting apparatus must erected within and operated within a vertically restrictive space such as a building's crawl space. Where, for example, a building has a foundation footing extending two feet below ground level and has floor joists overlying ground level by three feet, the vertical distance between the building's floor joists and the undersurface of the foundation footing totals five feet. Such five foot vertical space would typically be recognized as a restricted. Steel pier segments which are initially downwardly driven into the earth from within such a restricted space are necessarily shortened to at least five feet in length. However, the typically completely annular and completely circumferential configuration of the collet clamp assembly typically vertically partitions such five feet of useable vertical work space at a point no lower than the upper ends of the hydraulic cylinders which are utilized for pier driving and foundation jacking. Such vertical partitioning effect imposed within an already restricted vertical space (such as the exemplary five foot installation space) undesirably further limits the lengths of pier sections which may be utilized. The requirement of use of further shortened pier sections within such restricted vertical work space undesirably multiplies pier installation steps, is time consuming, and magnifies the risk that the above ground portion of the vertical string of shortened pier sections will laterally buckle.

The instant inventive assembly for driving pier sections and for foundation lifting solves or ameliorates the drawbacks and deficiencies of commonly known configurations of foundation jacking assemblies noted above by incorporating within such assembly a specially configured "T" bar which transfers deforming torque or twisting forces away from the collet clamp's drawing sleeve and which downwardly move the location of the vertical partition imposed by such drawing sleeve.

BRIEF SUMMARY OF THE INVENTION

A central or key structural component of the instant inventive assembly for driving pier sections and for foundation lifting comprises a "T" bar having a vertically extending stem section, and having laterally cantilevering left and right arms. Each of the left and right arms of the "T" bar preferably is configured as an eyed flange which is receivable within a clevis mount of a hydraulic cylinder, or is configured as an eyed clevis for receiving an eye loop mount of a hydraulic cylinder. In a preferred embodiment, the left and right arms of the "T" bar are fixedly welded to such bar's stem section at its upper end. Suitably, such arms may be wholly formed with the "T" bar's stem section in a casting or milling process.

Also in the preferred embodiment of the instant invention, the vertically extending stem section of the "T" bar forms and defines a vertically extending pier section receiving channel, such channel preferably opening rearwardly. Where, for example, the instant inventive assembly is adapted for driving steel piers having a three inch outside diameter, the rearward opening of the stem's vertically extending channel is preferably sized to have at least a three inch lateral or left to right dimension in order to allow forward insertions of pier sections into the channel. The upper end and lower end of the pier segment receiving channel within the "T" bar's stem section are preferably open for vertical movement of pier sections therethrough, and all portions of the "T" bar preferably comprise steel. For reasons further explained below, it is preferred that the horizontal cross-sectional shape of the "T" bar's stem section be circular and be "C" shaped.

A further structural component of the instant inventive assembly for driving pier sections and for foundation lifting comprises means for alternatively clamping and releasing pier sections. In a preferred embodiment of the instant invention, such means comprises a collet claim which includes a conically bored drawing sleeve and a plurality of wedge shaped collet shoes slidably captured within the drawing sleeve. Preferably, three of such wedge shaped collet shoes are provided, each having a circumferentially toothed inner periphery matching the radius of curvature of the outer surface of a pier section to be clamped. Each such wedge shaped collet shoe also has a conically shaped outer periphery matching a portion of the downwardly flared conical bore of the drawing sleeve. While such collet shoe and drawing sleeve assembly comprises a preferred pier segment clamping means, other means for securely clamping and holding tubular members are considered to fall within the scope of the invention.

A further component of the instant inventive assembly preferably comprises means for interconnecting the "T" bar stem's lower end and the pier clamping means. Such means preferably comprises a weld extending about the preferably matchingly circular periphery of the upper end of the pier clamp's preferred collet clamp drawing sleeve. Such an abutting juncture between the base of the "T" bar and the upper end of the drawing sleeve combined, with the preferred welded attaching means, advantageously securely interconnects those two components while providing high resistance against lateral buckling of those two components with respect to each. Suitably, other commonly known attaching means such as bolted attachments, riveted attachments, and helically threaded attachments may be substituted for the preferred welded attachment.

A further structural component of the instant inventive assembly comprises a preferably cylindrical slide sleeve whose bore is closely fitted for sliding receipt of the pier sections. A foundation hooking member, preferably configured as a heavy length of steel "I" beam, is preferably fixedly welded to an outer wall of the slide sleeve, and such foundation hooking member is preferably oriented so that it may extend forwardly from the slide sleeve and from a pier received within such sleeve, to a position directly underlying the undersurface of foundation's footing.

Further structural components of the instant inventive assembly for driving pier sections and for foundation lifting comprises left and right linear motion actuators, each having lower and upper ends. The upper ends of such actuators are preferably respectively fixedly attached to the "T" bar's left and right arms, and the lower ends of such actuators are in turn preferably operatively attached to the underlying slide sleeve. In a preferred embodiment of the instant invention, the left and right linear motion actuators comprise two way hydraulic cylinders. Other commonly known linear motion actuators such a pneumatic cylinders and electric motor driven ball screw actuators may be suitably substituted for the preferred two way hydraulic cylinders.

In operation of the instant inventive assembly for driving pier sections and for foundation lifting, levering torque applied by the preferably hydraulic cylinder powered linear motion actuators to the "T" bar's left and right arms tends to harmlessly elastically flex, or upon extreme loading deform, the upper end of the "T" bar's stem section without imposing any undesirable flexion or deformation at the site of the collet clamp's drawing sleeve. By transferring such flexion and material deforming effect away from the drawing sleeve component to the upper end of the "T" bar's stem section, the instant invention advantageously preserves the collet clamp's ability to grasp pier sections without slippage upon extreme loading. Additionally, by positioning the collet clamp at the lower end of the vertically channeled stem of the "T" bar, the instant inventive assembly downwardly transfers or relocates the site of the vertical partitioning effect which is inherently imposed by the annular nature of the collet clamp, such relocation advantageously lengthening the effective vertical space which is available for pier section insertions within vertically restrictive crawl space foundation lifting locations. Such vertical repositioning of the collet clamp beneficially saves processing time in the assembly of piers within such restrictive spaces, saves materials costs, and reduces the tendency of pier string sections exposed above ground to laterally buckle upon loading.

Accordingly, it is an object of the instant inventive assembly for driving pier sections and for foundation lifting to provide structures and structural assemblies, as described above, which are capable of performing beneficial functions as described above.

Other and further objects, benefits, and advantages of the present invention will become known to those skilled in the art upon review of the Detailed Description of a Preferred Embodiment which follows, and upon review of the appended drawings.

DETAILED DESCRIPTION OF A PREFERRED EMBODIMENT

Figure 1:
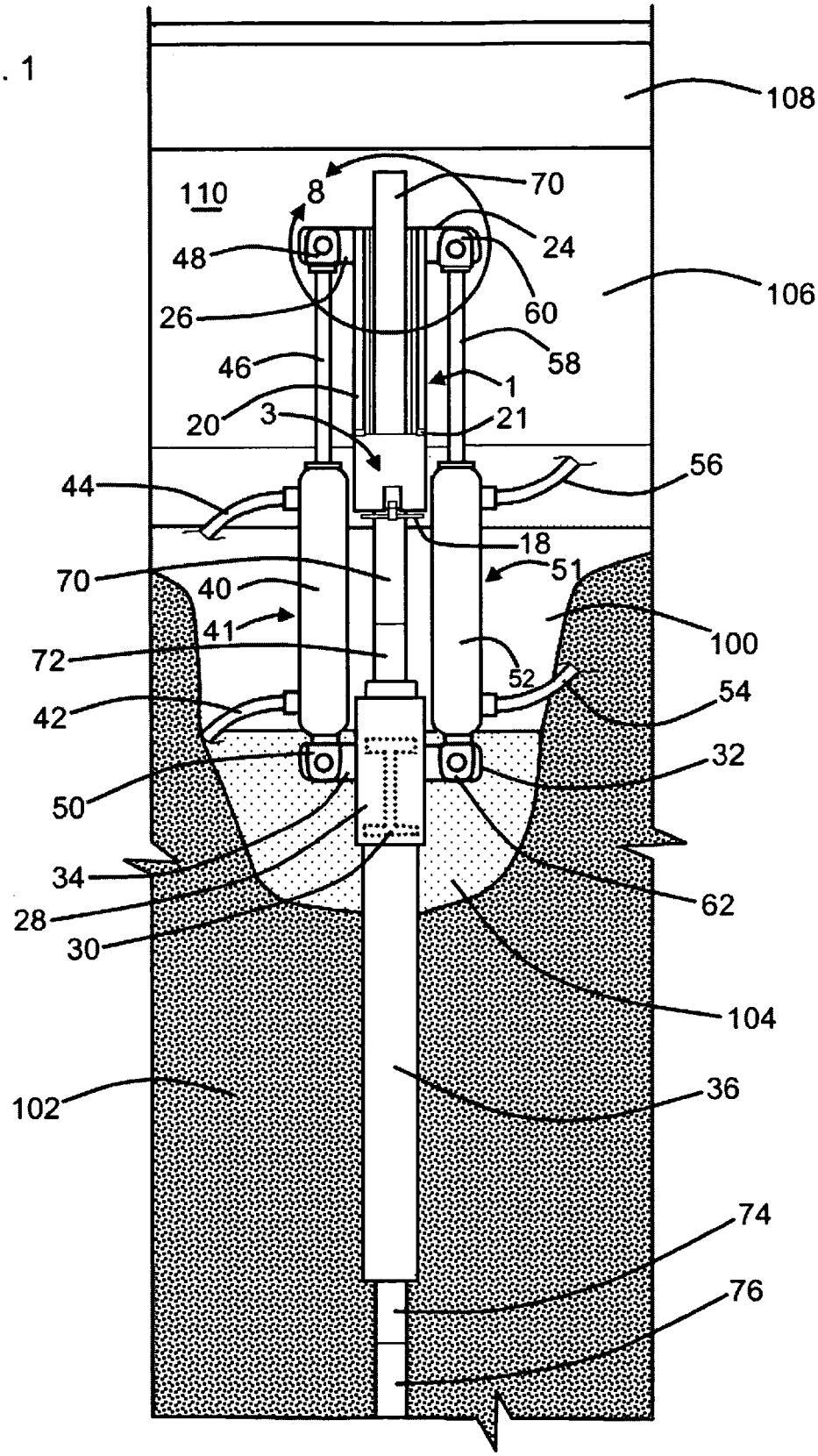
FIG. 1 is a rear plan view of a preferred embodiment of the instant assembly for driving pier sections and for foundation lifting.
Figure 3:
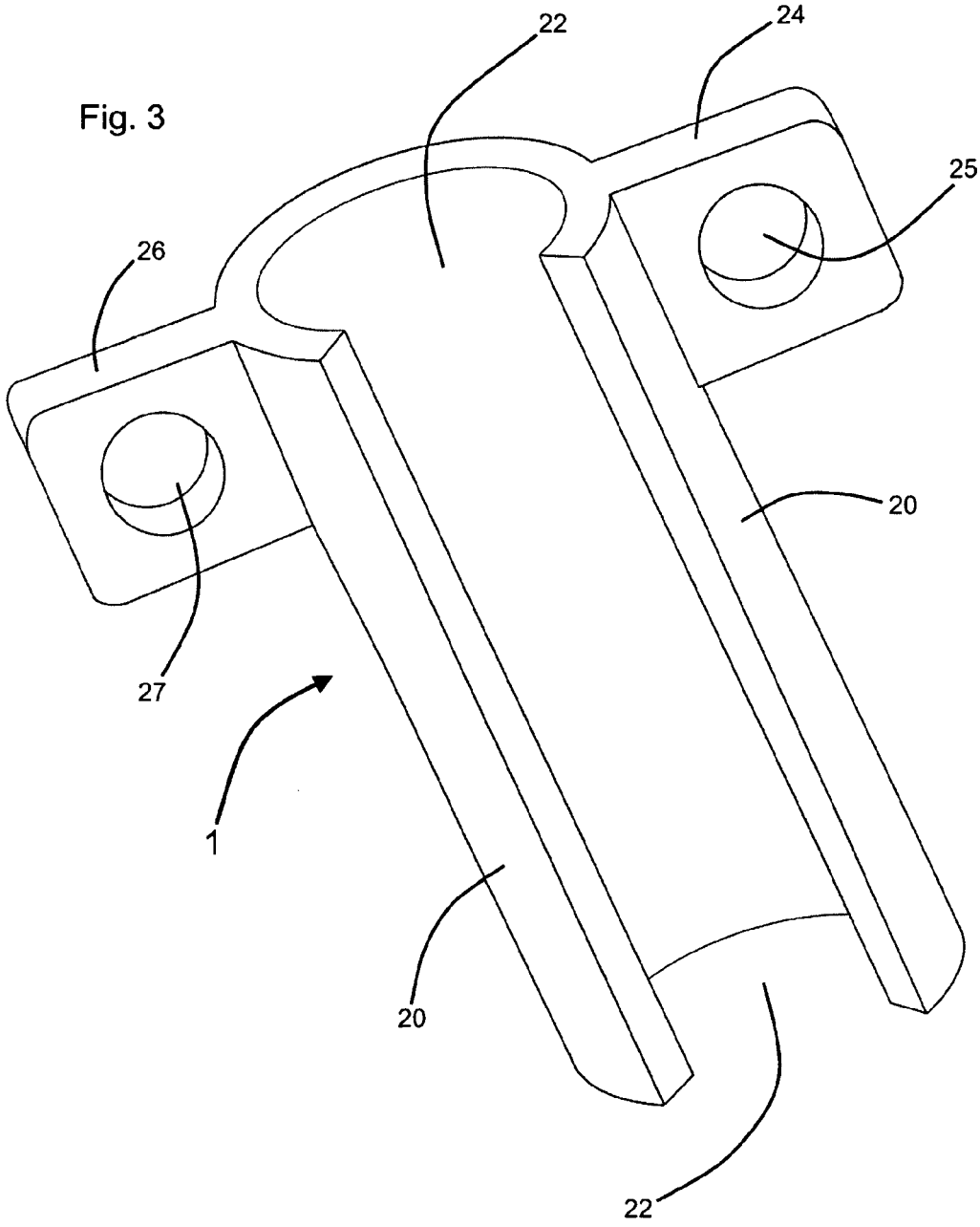
FIG. 3 is a perspective view of a "T" bar component of the instant inventive assembly.

Referring now to the drawings, and in particular to FIG. 3, a "T" bar component is referred to generally by Reference Arrow 1. The "T" bar 1 has a vertically extending stem section 20, and has right and left arms 24 and 26, such arms having attachment eyes 25 and 27 extending forwardly therethrough. While the arms 24 and 26 are drawn in FIG. 3 as eyed flanges which are typically receivable between the ears of a clevis mount, such arms 24 and 26 are considered as being additionally representative of leftwardly and rightwardly extending clevis mounts which may be alternatively substituted. The vertically extending stem section 20 of the "T" bar 1 preferably forms and defines a vertically extending channel 22. Such channel 22 preferably is open at its upper and lower ends and further opens along in the rearward direction along the stem's vertical length. Referring further simultaneously to FIG. 1, the width of the rearwardly opening of the channel 22 of the stem section 1 preferably facilitates free forward passage of vertically linkable steel pier sections 70, 72, 74, and 76. All of the components of the "T" bar 1 preferably comprise steel.

Referring further to FIG. 1, a collet clamp which is referred to generally by Reference Arrow 3 is preferably provided. Referring further simultaneously to the prior art configuration of FIG. 5, the collet clamp 3P is configured substantially identically to the collet clamp 3 depicted in FIG. 1. Also referring to FIG. 7, structures identified by a reference numeral having the suffix "P" are substantially identical to similarly situated structures of the assembly drawn in FIGS. 1-4. The collet clamp 3P has an annular or circumferentially extending drawing sleeve 2P which defines a vertically extending and conically shaped bore 4P. The conical bore 4P necessarily flares or widens downwardly so that the upper end 6P of the wall of the drawing sleeve 2P is thicker than the lower end 8P of such sleeve wall. A plurality of collet shoes 10P and 12P have inwardly extending pier biting or frictionally engaging teeth 11P and 13P, such shoes 10P and 12P being oppositely wedge shaped (i.e., widening in the downward direction) with respect to the slope of the bore 4P of the drawing sleeve 2P. In operation of the collet clamp 3P, as the teeth 11P and 13P frictionally engage the outer wall of a pier section, 70 or 80 as the case may be, downwardly directed forces applied to the drawing sleeve 3P, tend to increase the radially inwardly directed frictional compression of the teeth 11P and 13P against such pier. Such compressive friction effectively annularly clamps the pier and prevents any vertical slipping movement of the pier with respect to the drawing sleeve 3P. Upon an opposite upward motion of the drawing sleeve 2P, the teeth 11P and 13P disengage from the pier and the wedge shaped collet shoes 10P and 12P tend to loosely drop downwardly within the bore 4P. To accommodate for such disengaging motion of the collet shoes 10P and 12P, a catch ring 18P which is actuated by a lever 14P mounted upon pivot 16P stops such downward falling motion of the shoes 10P and 12P. The lever 14P additionally allows for manually actuated preliminary engagement of the teeth 11P and 13P of the shoes 10P and 12P with the pier prior to application of downward loading forces.

Referring simultaneously to FIGS. 1-4, attaching means are preferably provided for rigidly and fixedly interconnecting the lower end of the "T" bar 1 with the upper end of the collet clamp 3, such means being represented by weld 21. The preferred circular and "C" shaped horizontal cross-sectional shape of the stem section 20 of the "T" bar advantageously matches the circular horizontal cross-sectional shape of the upper end of the drawing sleeve component of the collet clamp 3, such matching structures allowing the peripheral weld 21 to securely resist any lateral buckling upon loading. Suitably, other commonly known fastening means, such as helically threaded attachments, bolted attachments, or pin and eye attachments, may be substituted for the preferred weld 21 and are considered to fall within the scope of the invention.

Figure 2:
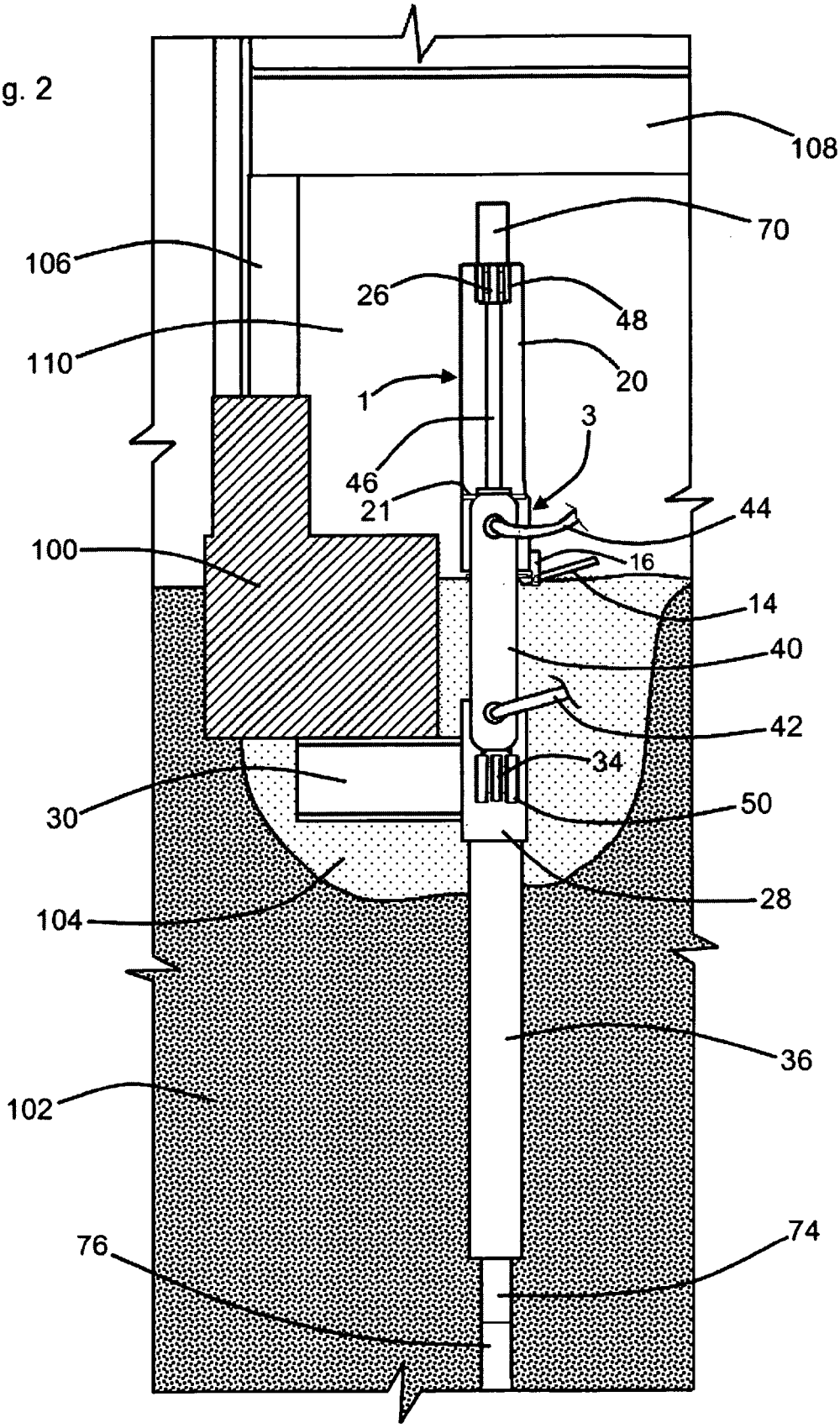
FIG. 2 is a side plan view of the assembly depicted in FIG. 1.

Referring to FIGS. 1 and 2, a slide sleeve 28,36, is preferably provided, such sleeve preferably comprising a short outer sleeve 28 and a longer inner sleeve 36. In operation of the slide sleeve 28,36 component, the outer sleeve 28 is initially positioned within an open pit 104 excavated next to and extending rearwardly beneath a foundation footing 100. The inner sleeve 36 is driven downwardly through the bore of the outer sleeve 28 into the ground 102 until it reaches the position within the ground depicted in FIG. 1. Upon such positioning, the inner sleeve 36 is preferably fixedly welded to the outer sleeve 28, such weldment 28,36, functioning together as a unitary slide sleeve. The downwardly lengthened character of the resultant slide sleeve 28,36, advantageously resists lateral pier buckling at the upper level of the ground 102.

Referring to FIG. 2, a foundation hooking member 30 is preferably fixedly attached to from the outer sleeve component 28 of the slide sleeve 28,30, such foundation hooking member 30 preferably comprising a steel "I" beam segment, and being fixedly welded to the outer wall of the sleeve component 28. The foundation hooking member 30 is preferably oriented to cantilever and extend forwardly from the pier and slide sleeve to a position directly underlying the of the concrete foundation footing 100. At such underlying position, the foundation hooking member 30 may utilize the foundation footing 100 as a temporary base for downwardly driving a string of pier sections, and, upon transition of base support from the foundation 100 to a subterranean structure such as bedrock at the lower end of the pier string, such hooking member 30 may directly lift the foundation.

Referring further to FIG. 1, left and right linear motion actuators, referred to generally by Reference Arrows 41 and 51, are preferably provided. The actuators 41 and 51 preferably comprise left and right two way hydraulic cylinders 40 and 52, such cylinders having extendable and retractable piston rods 46 and 58, and being powered via hydraulic lines 42, 44, and 54, 56. The left linear motion actuator 41 preferably has an upper attachment clevis 48 and a lower attachment clevis 50, and the right linear motion actuator 51 similarly has upper and lower attachment clevises 60 and 62. Said actuators' upper attachment clevises 48 and 60 are preferably respectively attached to the left and right arms 26 and 24 of the "T" bar 1. Such left and right linear motion actuators 41 and 51 preferably extend downwardly along the stem 20 of the "T" bar 1, and past the left and right sides of the collet clamp 3 to operatively attach to the slide sleeve 28,36. Such operative attachment is preferably facilitated by left and right eyed flanges 34 and 32 which are attached to and extend leftwardly and rightwardly from the outer sleeve component 28, the eyed flanges 34 and 32 respectively being received within clevises 50 and 62 at the lower ends of the hydraulic cylinders 40 and 52.

In the preferred embodiment of the instant inventive assembly depicted in FIG. 1, it may be seen that the left and right arms 26 and 24 of the "T" bar and the slide sleeve's left and right eyed flanges 34 and 32 are specially sized so that they respectively displace the cylinders 42 and 50 leftwardly and rightwardly away from each other a distance sufficient to allow downward passage therebetween of the collet clamp 3.

Referring further to FIG. 1, the preferred two way hydraulic cylinder linear motion actuators 41 and 51 are intended as being representative of other suitably substituted linear motion actuators such as pneumatic cylinders, electric motor driven jack screw assemblies, electric motor ball screw assemblies, and the like.

Figure 4:
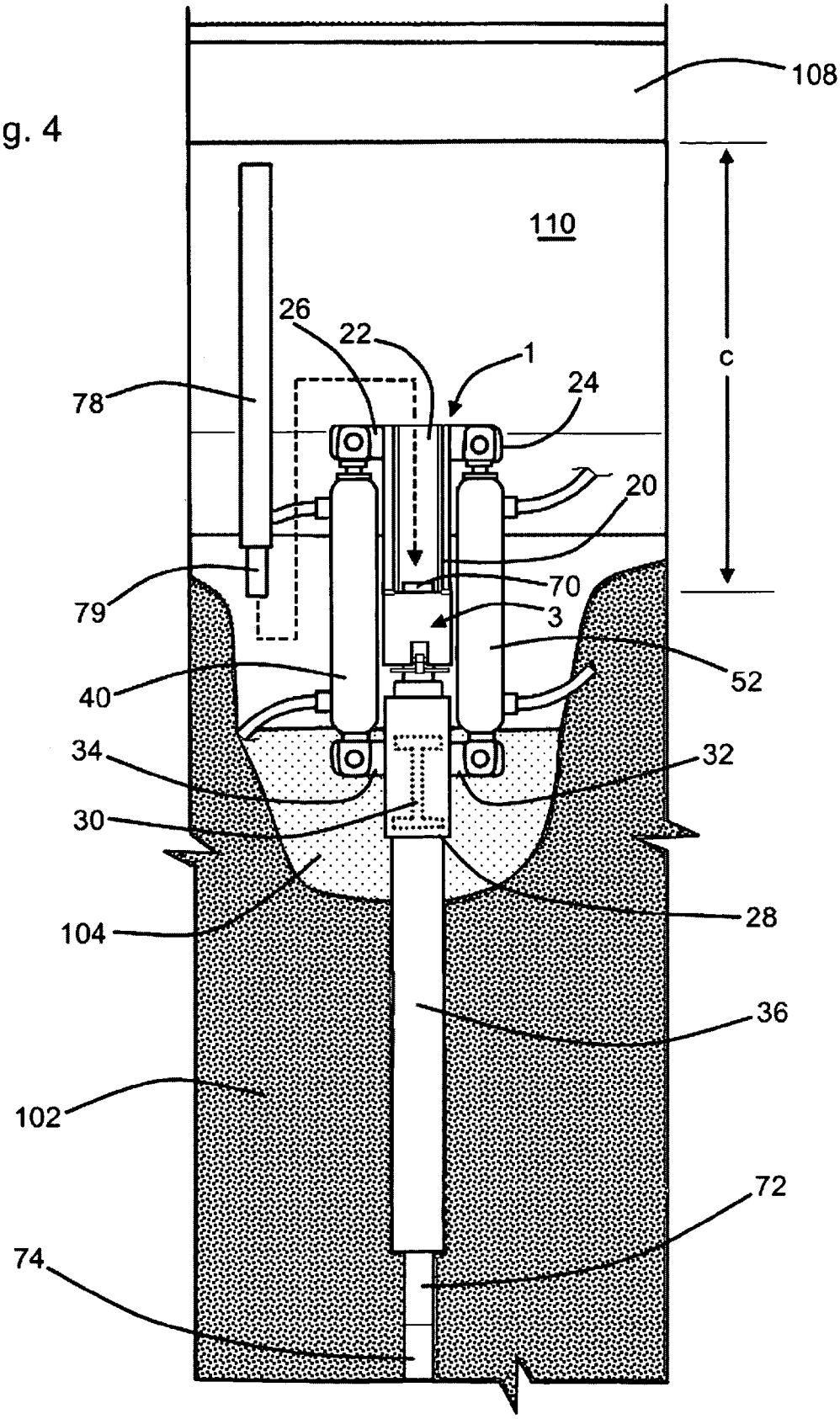
FIG. 4 redepicts FIG. 1, the view of FIG. 4 showing hydraulic cylinders retracted and showing a pier section in an exploded configuration.
Figure 5:
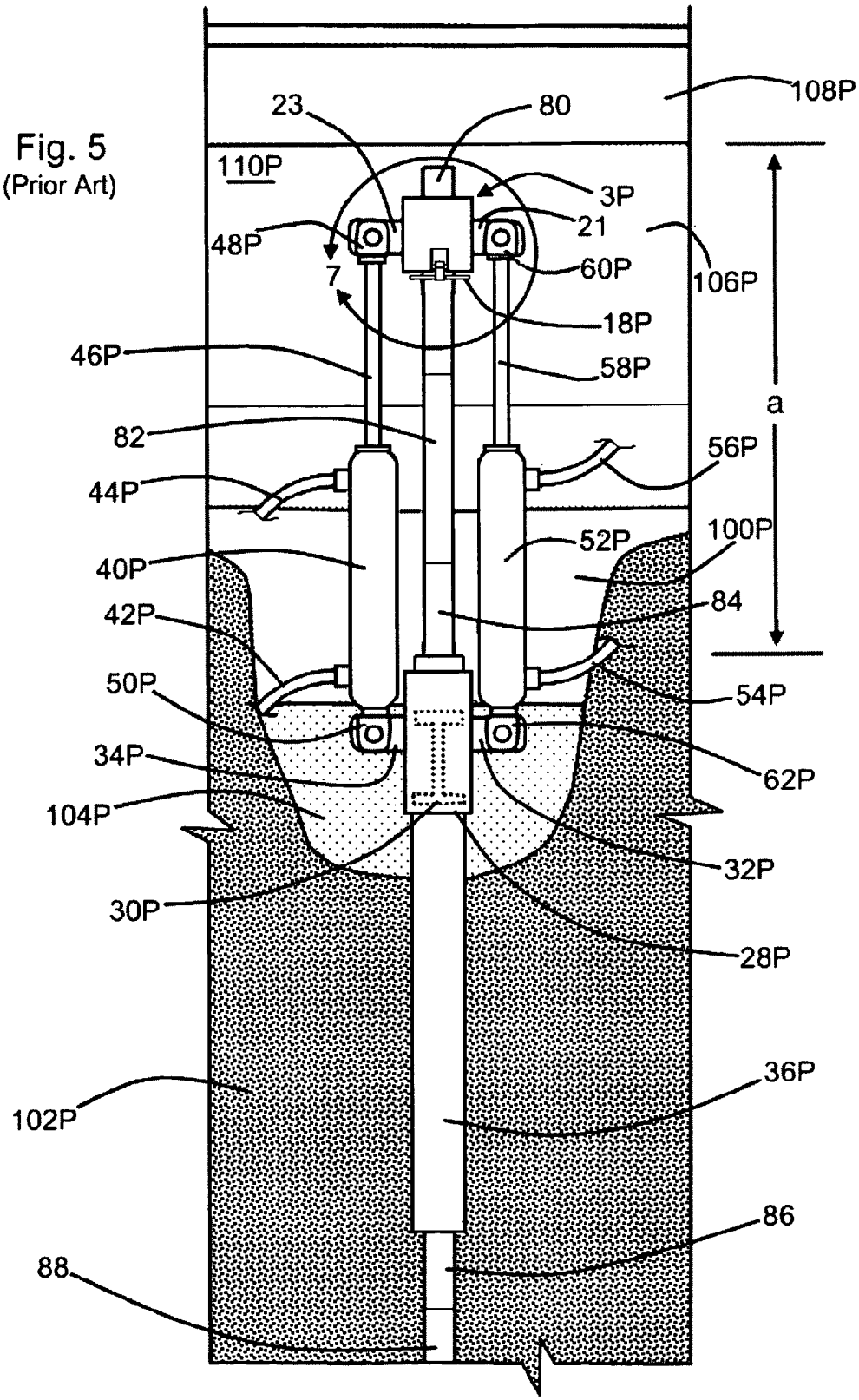
Fig. 5 (Prior Art)
FIG. 5 is a rear view of a prior art assembly.
Figure 6:
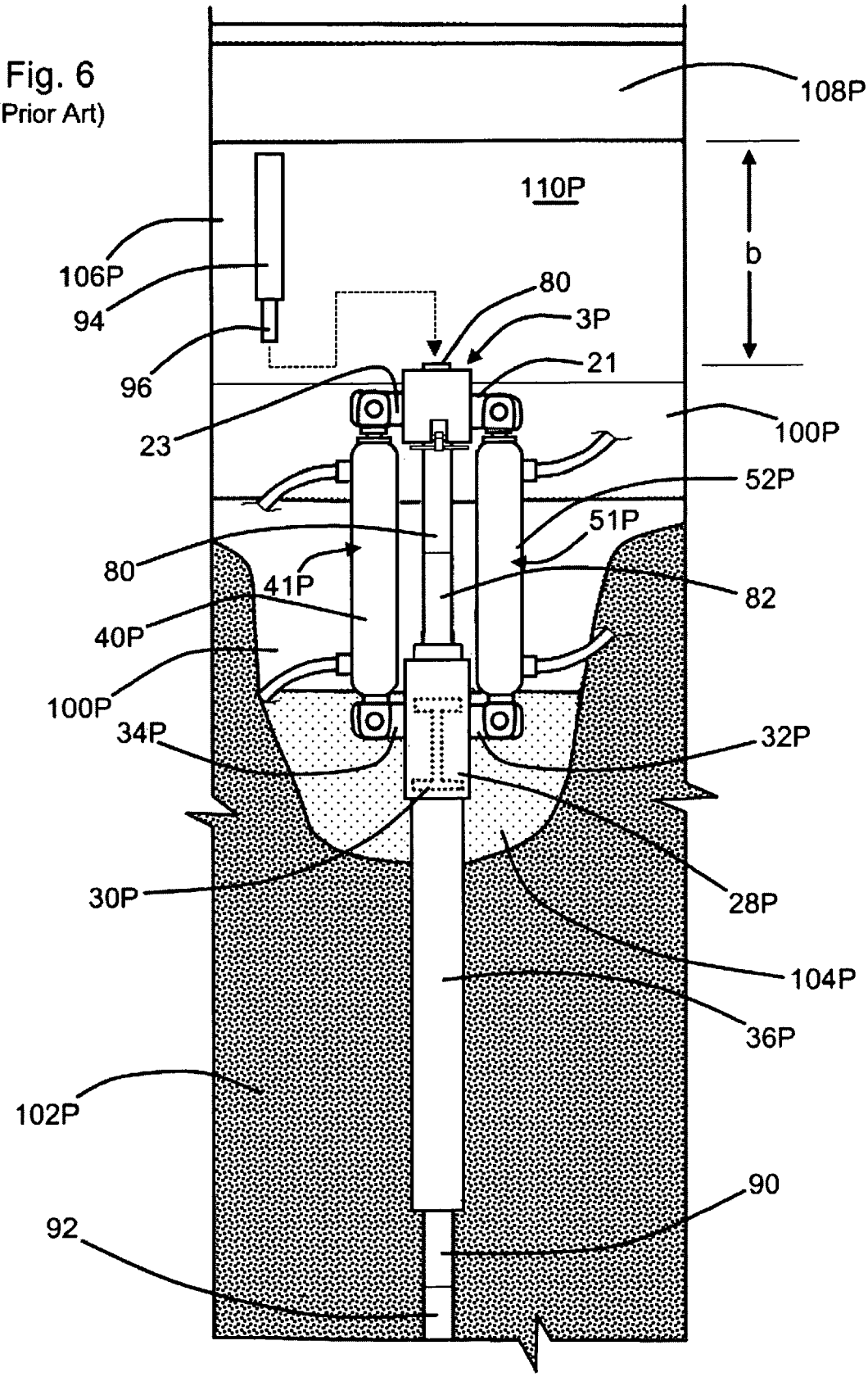
Fig. 6 (Prior Art)
FIG. 6 redepicts the assembly of FIG. 5 in an alternative configuration, the view showing hydraulic cylinders retracted.

Referring to the prior art pier driving and foundation lifting assembly depicted in FIG. 5, all structures identified by a reference numeral having the suffix "P" are configured substantially identically with corresponding structures drawn in FIGS. 1-4, and structures identified by reference numerals lacking a suffix "P" denote structural differences from the instant invention. A building's crawl space 110P is depicted in FIG. 5, such space being upwardly bounded by the building's floor and floor joists or trusses 108P, such space being downwardly bounded by the upper surface of the ground 102P, and such space being laterally bounded by the building's exterior wall 106P. Where steel pier segments are to be successively driven by the assembly downwardly into the ground 102P, the vertical distance "a" designated in FIG. 5 represents a maximum vertical clearance dimension which is available to an operator for successive insertions of pier segments. The upper limit of such clearance dimension "a" is the lower surface of the floor joists 108P, and the lower limit of such dimension is situated at the lip of the upper opening of the slide sleeve 28P,36P. However, the collet clamp 3P which successively receives and drives against pier segments 80, 82, 84, 86, and 88 is necessarily completely annular in order to effectively function as a clamp. Accordingly, the collet clamp 3P partitions or vertically divides the clearance dimension "a". Referring further simultaneously to FIG. 6, it may be seen that in the depicted prior art configuration, the hydraulic cylinders 40P and 52P are attached to the collet clamp 3P via left and right eyed flanges 23 and 21 which are welded directly to the outer surface of the collet clamp 3P. Accordingly, upon retraction of the left and right linear motion actuators 41P and 51P, the downward travel of the collet clamp 3P is stopped at an elevation matching that of the upper ends of the cylinders 40P and 52P. Thus, in the prior art configuration of FIGS. 5 and 6, the vertical space partitioning effect of the collet clamp 3P occurs at a vertical elevation substantially overlying the upper opening of the slide sleeve 28P,36P. As a result, the effective clearance dimension which is available for successive pier insertions is undesirably reduced to the vertical dimension "b" which is depicted and represented in FIG. 6. Accordingly, in the prior art configuration, undesirably short pier segments, such as pier 94 having a lower mounting pin 96, are required to be utilized for assembly of the downwardly extending pier string. Such string of shortened pier segments 94, 80, 82, 84, 90, and 92 undesirably multiplies pier installation steps and undesirably increases materials cost. Also, as is depicted in FIG. 5, the requirement in the prior art configuration of utilization of multiple short pier segments undesirably exposes one or more pier segment joints above ground, which upon loading magnifies the risk of lateral above ground buckling of the pier segment string.

Figure 7:
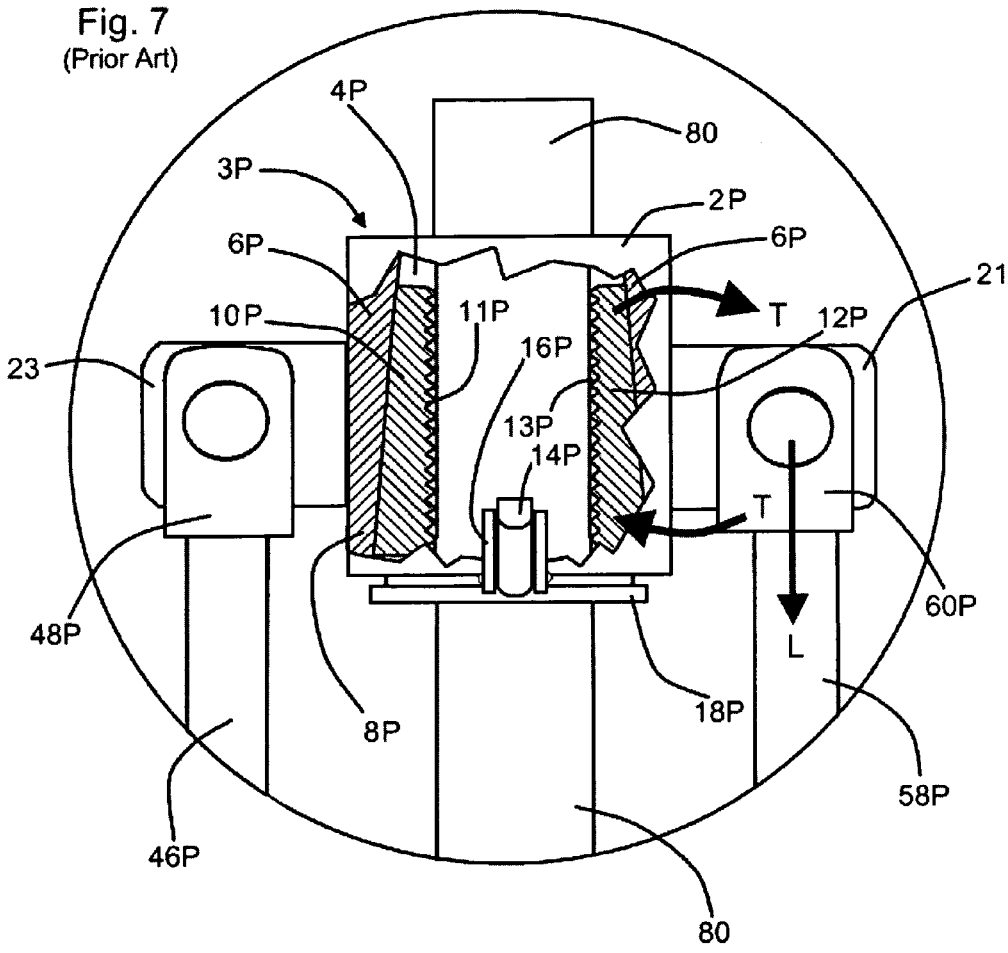
Fig. 7 (Prior Art)
FIG. 7 is a magnified view of a portion of the structure depicted in FIG. 5, as indicated in FIG. 5, the drawing sleeve structure of FIG. 7 including a "cutaway window" for explanation of underlying structures.

In addition to the undesirable vertical clearance dimension partitioning effect of the prior art configuration depicted in FIGS. 5-7, such prior art configuration also undesirably increases the risk of collet clamp slippage upon downward loading. Referring to FIGS. 5 and 7, hydraulic cylinder 52P may draw downwardly upon its piston rod 58P and upon attachment flange 21 which, according to the teachings of the prior art, is fixedly attached by welding to the outer surface of the drawing sleeve 2 of the collet clamp 3P. Reference Arrow "L" designates such downward loading or pulling force, and curved Reference Arrows "T" represent resultant torque or twisting forces which are thereby applied to the drawing sleeve 2P. Such torque or twisting forces "T" drive or twist inwardly against the closing sleeve 2P at its thinned lower end 8P. Upon application of extreme loading forces, such twisting forces "T" tend to cause the drawing sleeve 2P to either elastically or plastically deform from its necessary circular configuration to a slightly oval configuration whose long axis extends forwardly and rearwardly. Upon occurrence of such deformation of the lower end 8P of the drawing sleeve 2P, the teeth 11P and 13P of the collet shoes 10P and 12P tend to unevenly compress against the pier section 80. Such torque moment induced deformation of the drawing sleeve 2P tends to interfere with secure clamping of the pier 80, allowing the collet clamp 3P, upon extreme loading, to slip along the pier 80.

In contrast, referring to FIG. 4, it may be seen that the stem 20 of the "T" bar 1 component of the instant inventive assembly advantageously downwardly displaces the collet clamp 3 from the level of the upper ends of the cylinders 40 and 52 (as depicted in prior art FIG. 6) to a level immediately overlying the upper opening of the slide sleeve 28,36. Accordingly, the undesirable vertical space partitioning effect imposed by the collet clamp 3 is advantageously shifted downwardly to create an enhanced vertical space "c" for pier segment insertions. In use, cylinders 40 and 52 may be actuated to downwardly draw the "T" bar 1 and its attached collet clamp 3 to the downwardly shifted position depicted in FIG. 4. Thereafter, an enhanced length pier segment 78 having a lower attachment pin 79 may be inserted via rearward and downward motion into "T" bar's channel 22 for receipt of such pin 79 into the upper opening of an immediately underlying pier segment 70. Thereafter, upward and downward reciprocating motion of the collet clamp 3 induced by alternating upward and downward actuations of the hydraulic cylinders 40 and 52 may progressively drive the pier segment 78 downwardly as a part of the string of pier segments. By lengthening the pier segments which may be utilized in foundation lifting operations performed within restrictive vertical spaces such as the building crawl space 110, the instant invention reduces pier installation process steps, saves time, and reduces material costs. Additionally, the lengthening of the piers advantageously minimizes the risk of above ground pier buckling.

Figure 8:
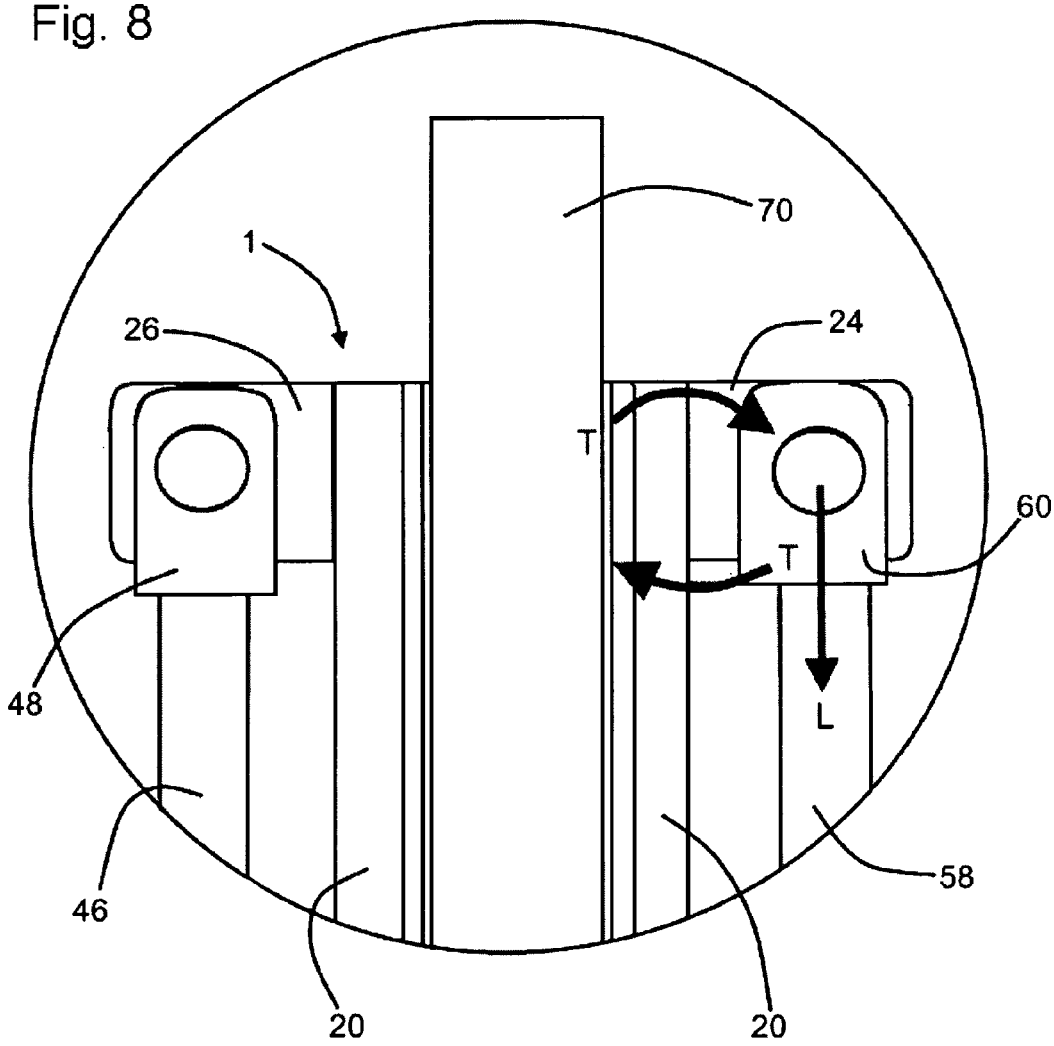
FIG. 8 is a magnified view of a portion of the structure of FIG. 1, as indicated in FIG. 1.

Referring simultaneously to FIGS. 7 and 8, where the stem 20 of the instant inventive assembly is exposed to torque or twisting forces "T" from downward pulling loads applied to the arms 24 and 26, such torque tends to harmlessly deform (either elastically or plastically) the channel wall at the upper end of the stem section 20. Referring further simultaneously to FIG. 1, the collet clamp 3, which is repositioned by the instant invention to the lower end of the stem 20, advantageously remains unaffected by such channel wall deforming forces. Accordingly, the instant inventive assembly provides both an enhanced vertical space for pier segment insertions and protection against collet clamp slippage by directing torque and twisting forces away from the collet clamp's drawing sleeve.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An assembly for driving pier sections and for foundation lifting, the assembly comprising:

(a) a "T" bar having a stem, a left arm, and a right arm, the stem having upper and lower ends and having a vertically extending and rearwardly opening channel, said channel being fitted for receipt of the pier sections;

(b) means for alternatively clamping and releasing pier sections, said means having an upper end;

(c) attaching means interconnecting the stem's lower end and the clamping and releasing mean's upper end;

(d) a sleeve having a bore fitted for sliding receipt of the pier sections;

(e) left and right linear motion actuators, each having upper and lower ends, the upper ends of the left and right linear motion actuators being respectively fixedly attached to the "T" bar's left and right arms, and the lower ends of the left and right linear motion actuators each being connected to the sleeve; and (f) a foundation hooking member fixedly attached to and extending forwardly from the slide sleeve.

2. The assembly of claim 1 wherein the "T" bar stem's rearwardly opening channel further opens upwardly and downwardly.

3. The assembly of claim 2 wherein each arm among the "T" bar's left and right arms comprises a cantilevering member selected from the group consisting of eyed flanges and eyed clevises.

4. The assembly of claim 3 wherein the stem has a "C" shaped horizontal cross sectional shape.

5. The assembly of claim 1 wherein the means for alternatively clamping and releasing pier sections comprises a collet clamp.

6. The assembly of claim 5 wherein the collet clamp comprises a drawing sleeve and collet shoes assembly.

7. The assembly of claim 6 wherein each actuator among the left and right linear motion actuators comprises a two way hydraulic cylinder, and wherein the collet clamp is fitted for passage between said cylinders.

8. The assembly of claim 7 wherein, upon retraction of the left and right linear motion actuators, the collet clamp and the "T" bar's lower end extend below the upper ends of the left and right linear motion actuators.

9. The assembly of claim 8 wherein the attaching means comprises a weld.

* * * * *